US005523131A

United States Patent [19]

Isaacs et al.

[11] Patent Number: 5,523,131

[45] Date of Patent: Jun. 4, 1996

[54] SELF-PROPELLED TABLE NOVELTY DEVICE

[75] Inventors: Linda R. F. Isaacs; Judah Isaacs, both of Far Rockaway, N.Y.

[73] Assignee: Innovative Premiums Inc., New York City, N.Y.

[21] Appl. No.: 332,999

[22] Filed: Nov. 1, 1994

[51] Int. Cl.[6] ..... A47G 19/22

[52] U.S. Cl. ..... 428/34.1; 446/464

[58] Field of Search ..... 446/330, 352, 446/464; 428/7–16, 34.1

[56] References Cited

U.S. PATENT DOCUMENTS

| | | | |
|---|---|---|---|
| 3,619,939 | 11/1971 | Vidal | 446/464 |
| 4,077,156 | 3/1978 | Asano | 446/464 |
| 4,654,274 | 3/1987 | De Mars | 428/16 X |
| 4,710,147 | 12/1987 | Wakase | 446/464 |
| 4,842,567 | 6/1989 | Hiraide | 446/464 |
| 5,131,882 | 7/1992 | Kiyokane | 446/464 |

*Primary Examiner*—Henry F. Epstein
*Attorney, Agent, or Firm*—Helfgott & Karas

[57] ABSTRACT

A table top item, for example, a small cup, is made mobile by operation of a concealed spring-back rolling motor after the motor has been manually energized. A conventional spring-back motor, as used in automobiles models, is the motor for the table novelty device. Other items can be mobilized, for example, ashtrays, candy dishes, condiment holders, toothpick holders, etc. For a cup, a tilt is added to the cup body to prevent spillage of liquid contents when the cup decelerates in its travel. In use, a sending person grasps the novelty device and drags it backwards across a table top surface so as to rotate the motor wheels in the direction that "winds up" the motor. Upon release, the device travels in the other direction,

6 Claims, 2 Drawing Sheets

SELF-PROPELLED TABLE NOVELTY DEVICE

BACKGROUND OF THE INVENTION

This invention relates generally to a novelty item, which is intended to attract attention, and perhaps gain favorable comments and a few laughs from participants at a social gathering. More particularly, this invention relates to table top devices, such as a cup, that normally stand statically on a table top surface until used. By means of the invention, the device is made suddenly mobile and thereby can provide an element of surprise and amusement for those at the table.

There has always been a large market for novelty items that give a new and unexpected aspect to an otherwise ordinary item, frequently an item that is not normally given notice. Thus, for example, a rock may become a pet and a plastic spider that walks down a wall is considered amusing.

A problem arises with these devices when the novelty wears off. There is an ongoing need for new and different "novelty" items, especially those of low cost.

SUMMARY OF THE INVENTION

Accordingly, it is an object of the invention to provide a new novelty device that adds a new dimension to otherwise conventional table top items.

Another object of the invention is to provide a table novelty device that has intrinsic utility.

Yet another object of the invention is to provide a table novelty device that is simple and economical to produce.

Generally speaking, in accordance with the invention, a table top item, for example, a small cup, is made mobile by attachment of a concealed motor that enables the cup to roll across a table top—self-propelled. A conventional spring back motor, as commonly used in small toy automobiles, is used as the motor for the table novelty device. The motor is energized for each use by the person who sends the item moving across the table.

Different items can be made mobile by inclusion of a motor, for example, the aforementioned cup, ashtrays, candy dishes, condiment holders, toothpick holders, etc. When making a cup mobile, a tilt is added to the cup body to prevent spillage of liquid contents from the cup. This spillage tends to occur when the cup decelerates after its travel. Small objects are transported with a motor having two drive wheels whereas larger objects may be transported by a motor having four wheels, of which two wheels are driven.

In use, the sending person grasps the device to be activated and in a known manner with such motors, drags the device backwards across the table top surface so as to rotate the motor wheels in the direction that "winds up" the motor. Upon release, the device travels across the table top surface, propelled by the energy that was stored in the motor when the device was dragged backwards across the table top surface.

This invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF THE PREFERRED EMBODIMENTS

Figure 1:
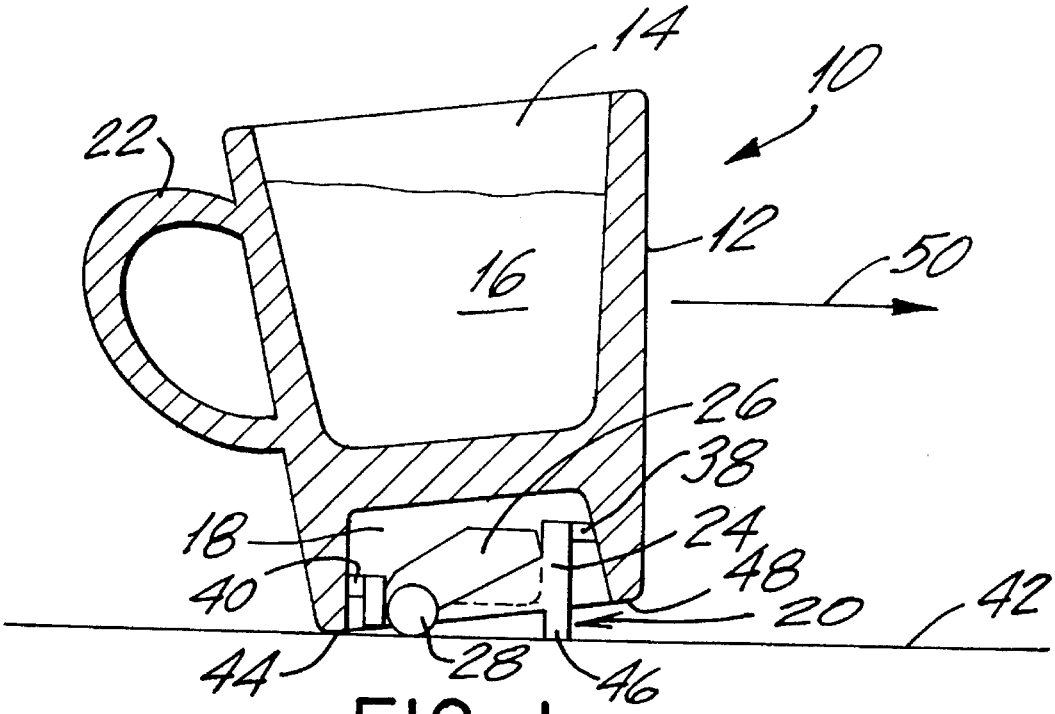
FIG. 1 is a table novelty device, a motorized drinking cup, in section, in accordance with the invention.
Figure 2:
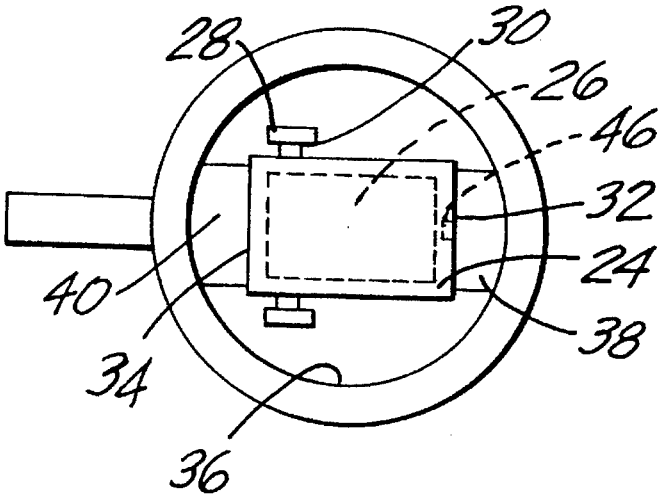
FIG. 2 is a bottom view of the device of FIG. 1.

With reference to FIGS. 1 and 2, a self propelled cup includes a cup body 12 having an upper cavity 14 for holding a liquid 16 and a lower cavity 18 concealing therein a driving mechanism 20. The cup body 12 has a handle 22 that is integrally attached.

The driving mechanism 20 includes a framework 24 that cradles a motor 26 having a pair of wheels 28 mounted for rotation upon a common driven axle 30.

The motor 26 is fixed in the framework 24, for example, with an adhesive, and the framework 24 is joined at its front 32 and rear 34 to the inner wall 36 of the lower cavity 18 by means of connecting webs 38, 40.

For a novelty item 10 of this type, the cup body 12 can be fabricated of one piece from plastic as is the framework 24, and webs 38, 40. The webs may be formed integrally with the framework 24 and connected to the inner wall 36 of the cup body 12 with an appropriate adhesive.

The framework 24 is positioned in the cup body 12, and the motor 26 with its wheels 28, is positioned such that when the wheels 28 rest on a table top 42, the trailing edge 44 of the cup 10 is elevated above the table top 42. For purposes of this invention a "table top" is intended to include all generally horizontal surfaces such as found on tables, desks, counters, cabinets, shelves, etc.

A small pedestal 46 extending downward at the forward end of the framework 24, concurrently with the wheels, contacts the table top surface 42 and elevates the leading edge 48 above the table top surface 42. For a cup 10 that is intended to carry a liquid, the leading edge 48 is elevated by the pedestal 46 to a greater elevation than is the trailing edge 44. Therefore, the entire cup 10 tilts back relative to the direction of travel, indicated by the arrow 50, which is parallel to the table top 42.

As is well known in the toy arts, especially with regard to small model automobiles, the motor 26 is of the spring type which "winds-up" its motor when the wheels 28 are rolled in the direction that is opposite to the direction 50 of intended travel. A ratchet device (not shown) within the motor 26 is usually provided to prevent overwinding.

After winding the motor, release of the cup 10 without lifting the wheels 28 from the table top surface 42 causes the motor to rotate the wheels. The cup 10 is propelled in the direction indicated by the arrow 50, until the power which had been stored in the motor is dissipated.

A cup 10 that is filled with liquid will accelerate slowly when released due to its weight and generally there is no spillage of the contained liquid 16. Upon deceleration, inertia of the liquid 16 tends to make the liquid ride up the inner wall of the upper cavity 14, in the direction 50 of travel. By setting the wheels 28 and pedestal 46 to pre-tilt the cup (FIG. 1), the potential for spillage of liquid 16 upon deceleration of the cup 10 is substantially reduced.

On smooth table tops the pedestal 46 tends to skim along the table surface 42 and may even become slightly elevated during acceleration. On rougher surfaces, for example, that are covered with a tablecloth (not shown), a four wheeled driving mechanism may be preferred.

A so-called whiskey "shot" glass or cup is considered to be an attractive application of the present invention. When a larger cup is to be used, a four-wheeled motor (not shown) may be used. The four-wheeled motor may be mounted into the framework 24 so the front wheels tilt the cup backward as illustrated for the embodiment of FIG. 1. Alternatively, the front wheels may be of larger diameter than the back wheels, and so forth as will be apparent to those skilled in the art, so as to provide the desired back-tilting.

Figure 3:
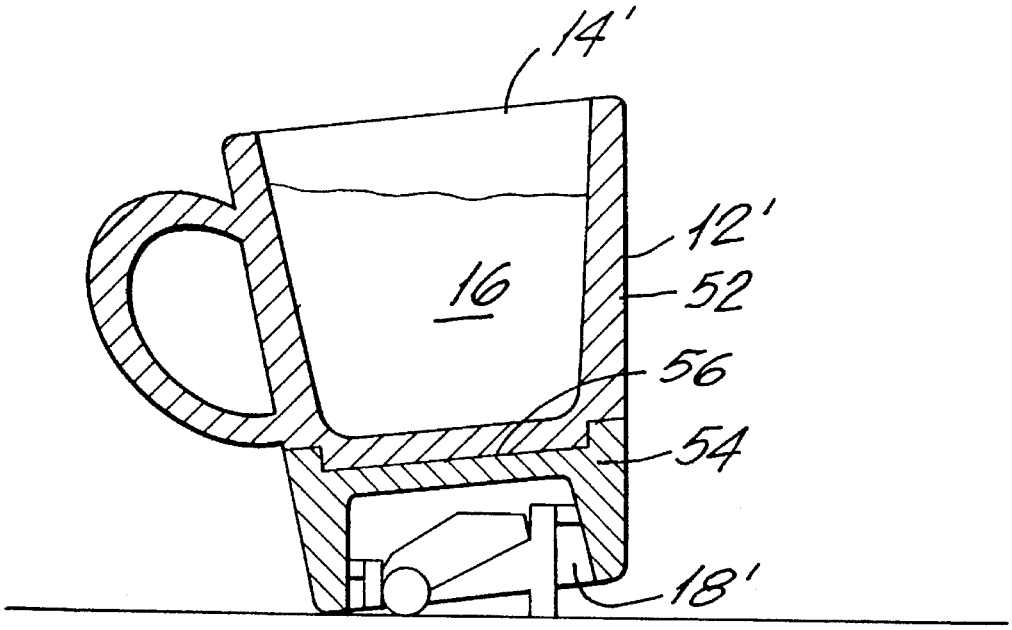
FIG. 3 is an alternative embodiment in accordance with the invention of a two-piece cup.

In an alternative embodiment (FIG. 3), the body 12' is composed of an upper element 52 that includes the upper cavity 14' and a lower element 54 that includes the lower cavity 18'. The upper and lower elements 52, 54 are separable along the parting line 56. Thus, the upper element 52 is readily detachable and may be washed after use whereas it is undesirable that the lower element 54, with the motor, be immersed in water. In all other respects, the cup of FIG. 3 is similar to the cup of FIGS. 1 and 2.

Figure 4:
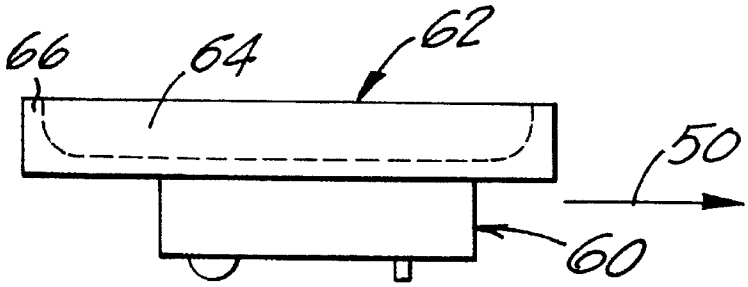
FIG. 4 is a side elevational view of another alternative embodiment of a table novelty device in accordance with the invention.

In this regard, the lower element 54 (FIG. 3) is a power unit to which many different objects (not shown) may be attached, fixedly or releasably, so that they become mobile. Thus, additional novelty items based upon the same concepts of the invention may be created. For example, novelty devices that transport a salt shaker and a pepper shaker, or a sugar bowl, may be provided. An ashtray may be mobilized, as can a candy dish or toothpick holder. All such novelty devices are intended to fall within the scope of the invention. FIG. 4 illustrates a moving platform 58 including a motor unit 60, compressing a concealed motor as in FIG. 1, and an attached receiver 62 having a recess 64 defined by a peripheral rim 66. The receiver may be used to transport candy, salt and pepper shakers, etc., and its upper surface may be contoured to receive a particular item.

Basically, those table items, which are generally fixed except when manually moved may be made mobile. For novelty items that are not intended to transport liquids, the tilted-back configuration is not necessary although it may be retained.

It will thus be seen that the objects set forth above and those made apparent from the preceding description are efficiently attained and since certain changes may be made in the above constructions without departing from the spirit or the scope of the invention, it is intended that all matter contained in the above description or shown in the accompanying drawings shall be interpreted as illustrative and not in a limiting sense.

What is claimed is:

1. A self-propelled drinking cup, comprising:

a body having a top portion which is a drinking cup;

motor means attached to an underside of said body, said motor means including roller traction means for propelling said drinking cup when said roller traction means rotates in a first direction, said motor means including means for storing energy when said roller traction means is rotated in a second direction opposite to said first direction, said motor means, when released for operation, converting said stored energy into rotation of said roller traction means in said first direction, rolling said drinking cup over a support surface and releasing said drinking cup causing said drinking cup to move across said support surface by said roller traction means acting against said support surface.

2. A drinking cup as in claim 1, wherein said body includes a bottom portion that at least partially surrounds said motor means.

3. A drinking cup as in claim 1, wherein said roller traction means includes at least one pair of wheels for rolling on said support surface, said drinking cup further comprising tilt means for contacting said support surface while tilting said cup.

4. A drinking cup as in claim 3, wherein said tilt means includes a pin extended downward from said drinking cup to a position for slidably contacting said support surface, and for maintaining a tilted orientation of said cup during motion of said cup.

5. A drinking cup as in claim 1, wherein said body further includes a bottom portion, said cup being one of integral with and separable from said bottom portion, said motor being attached to said bottom portion.

6. A drinking cup as in claim 5, wherein said bottom portion at least partially conceals said motor means.

* * * * *